US010857808B2

(12) United States Patent
Kencana et al.

(10) Patent No.: US 10,857,808 B2
(45) Date of Patent: Dec. 8, 2020

(54) CALIBRATING PRINTING PENS OF PRINT HEAD ASSEMBLIES

(71) Applicant: Hewlett-Packard Development Company, L.P., Spring, TX (US)

(72) Inventors: Andy/Prima Kencana, Singapore (SG); Peow Ng, Singapore (SG); Kang Leng Tan, Singapore (SG); Zixing Yao, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/483,274

(22) PCT Filed: Feb. 7, 2017

(86) PCT No.: PCT/US2017/016837

§ 371 (c)(1),
(2) Date: Aug. 2, 2019

(87) PCT Pub. No.: WO2018/147831

PCT Pub. Date: Aug. 16, 2018

(65) Prior Publication Data

US 2020/0001617 A1 Jan. 2, 2020

(51) Int. Cl.

| | |
|---|---|
| ***B41J 29/38*** | (2006.01) |
| ***B41J 2/21*** | (2006.01) |
| ***B41J 29/393*** | (2006.01) |

(52) U.S. Cl.

CPC ..... *B41J 2/2135* (2013.01); *B41J 2/2146* (2013.01); *B41J 29/393* (2013.01); *B41J 2029/3935* (2013.01); *B41J 2202/20* (2013.01)

(58) Field of Classification Search

CPC ..... B41J 29/393; B41J 2/2135

(Continued)

(56) References Cited

U.S. PATENT DOCUMENTS

| | | | |
|---|---|---|---|
| 4,470,052 | A | 9/1984 | Lovelady |
| 6,164,749 | A | 12/2000 | Williams |

(Continued)

FOREIGN PATENT DOCUMENTS

| | | |
|---|---|---|
| CA | 2837404 | 9/2014 |
| CN | 1273912 | 11/2000 |

(Continued)

OTHER PUBLICATIONS

Bernal, E et al, Improved Pen Alignment for Bidirectional Printing, Oct. 11, 2006, http://www.ingentaconnect.com/ ~ 22 pages.

*Primary Examiner* — Lam S Nguyen
(74) *Attorney, Agent, or Firm* — HP Inc. Patent Department

(57) ABSTRACT

Examples relating to calibrating printing pens of a print bead assembly in a printer are described. For example, techniques for calibrating a printing pen includes detecting position of a first symbol and a second symbol of a pattern from amongst multiple patterns in an alignment pattern, where each pattern is associated with art ideal deviation and the symbols are printed in a juxtaposed position. The ideal deviation is a predefined value of deviation between the symbols when the printing pen is aligned. Thereafter, determining an actual deviation, due to misalignment in the printing pen, between the symbols. Further the technique includes establishing a relation between the actual deviation and the ideal deviation for the multiple patterns and determining a value of the ideal deviation for a zero value of the actual deviation. The value of the ideal deviation is a corrective value of alignment for the printing pen.

15 Claims, 7 Drawing Sheets

(58) Field of Classification Search
USPC ..... 347/19
See application file for complete search history.

(56) References Cited

U.S. PATENT DOCUMENTS

| | | | | |
|---|---|---|---|---|
| 8,075,080 | B2 | 12/2011 | Albertalli et al. | |
| 8,132,885 | B2 | 3/2012 | Ramakrishnan et al. | |
| 8,477,165 | B2 | 7/2013 | Heath | |
| 8,749,830 | B2 | 6/2014 | Fisher et al. | |
| 8,757,762 | B2 | 6/2014 | Jimenez et al. | |
| 9,555,620 | B2 * | 1/2017 | Kawafuji | B41J 2/01 |
| 10,440,195 | B2 * | 10/2019 | Borrego Lebrato | B41J 2/04585 |
| 2004/0223032 | A1 | 11/2004 | Akase | |
| 2005/0270325 | A1 | 12/2005 | Cavill et al. | |
| 2010/0309240 | A1 * | 12/2010 | Tomida | B41J 29/393 347/12 |
| 2017/0334192 | A1 * | 11/2017 | Iida | H04N 1/4015 |

FOREIGN PATENT DOCUMENTS

| | | |
|---|---|---|
| CN | 1326403 | 12/2001 |
| CN | 103728858 | 4/2014 |
| CN | 104080615 | 10/2014 |
| JP | H06171091 | 6/1994 |
| JP | 2005324359 | 11/2005 |
| JP | 2010214805 | 9/2010 |

* cited by examiner

CALIBRATING PRINTING PENS OF PRINT HEAD ASSEMBLIES

BACKGROUND

Generally, a print head assembly in a printer has multiple ink cartridges having inks of different colors and multiple printing pens to print on a print media, such as a paper and a plastic sheet. The printing pens have a predefined orientation or alignment within the print head assembly and based on the alignment of the printing pens, content, such as, text, images, pictures, symbols are printed on the print media.

However, with prolonged usage of the printing pens for printing content on the print media or during replacement of the ink cartridges in the print head assembly, the alignment of the printing pens deviates from the original alignment and may sometimes become misaligned.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
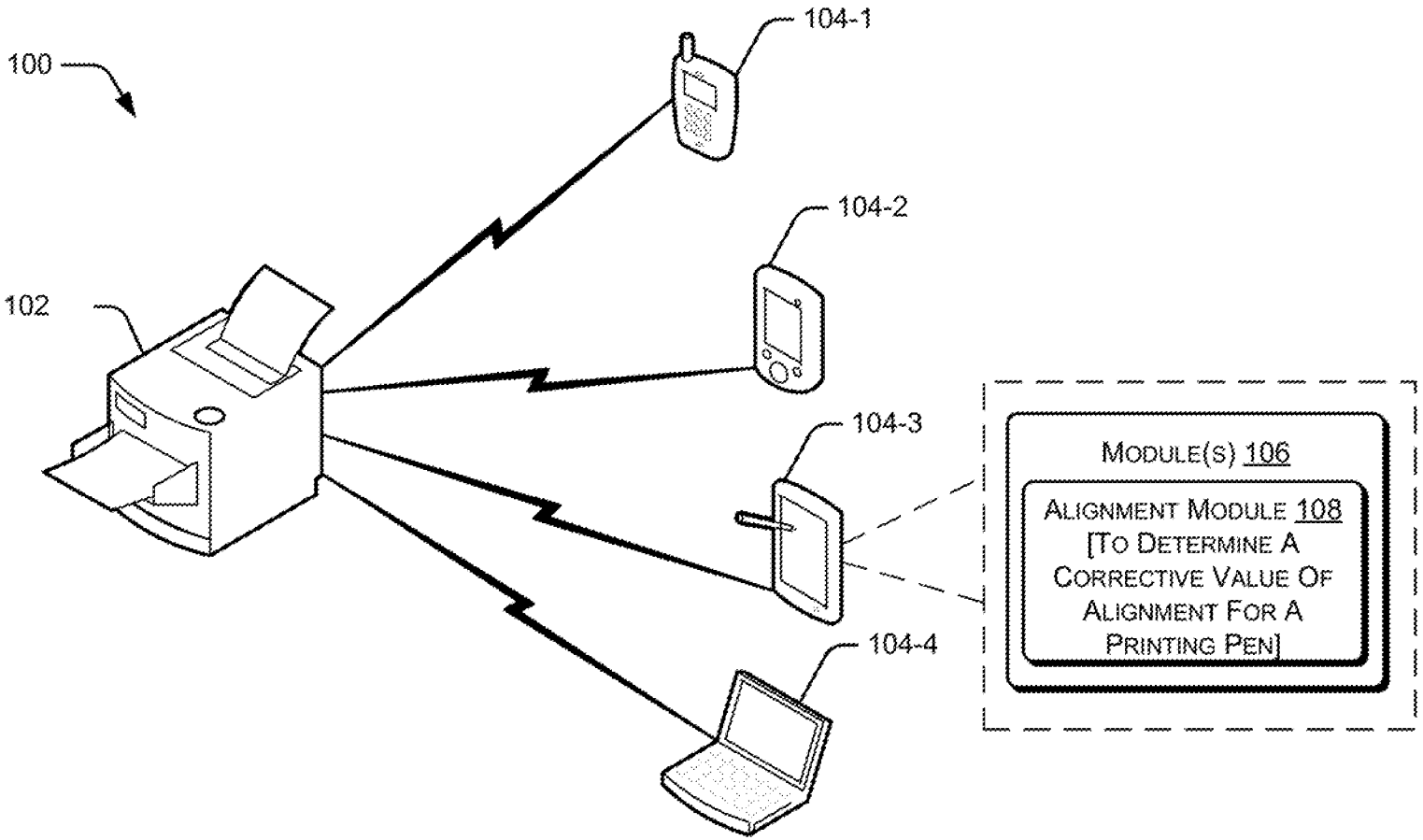
FIG. 1 illustrates an environment implementing a printer and multiple portable electronic devices, in accordance with an example implementation of the present subject mater.

Generally, misalignment in a printing pen occurs when position and orientation of the printing pen changes with respect to adjacent printing pens in the print head assembly due to factors such as prolonged printing by the printing pen or improper placement of the ink cartridges, for example, while replacing an ink cartridge within the print head assembly. The misalignment of the printing pen affects quality of printing as the orientation of content printed on the print media, such as a paper and a plastic sheet gets altered. To eliminate such misalignment, an alignment pattern printed by the printing pen on the print media is processed to detect the misalignment and the printing pen is calibrated to adjust and realign the printing pen within the print head assembly.

Techniques for detecting the misalignment of printing pens generally utilize devices, such as optical scanners and High Definition (HD) cameras to scan the alignment pattern. After scanning, the alignment pattern is processed to detect any misalignment. However, such devices are expensive and take time and processing resources to detect the misalignment. Additionally, the techniques do not take into account any image distortion caused during scanning of the alignment pattern. Consequently, the detected misalignment is often erroneous and inaccurate. In short, the general techniques utilized for the detection of the misalignment are time consuming, expensive and inefficient in calibrating the printing pens.

In accordance with an implementation of the present subject matter, techniques for calibrating a printing pen within a print head assembly of a printer are described. In said example, the printer may include multiple printing pens in the print head assembly, out of which more than one printing pens may be misaligned in position within the print head assembly. However, for brevity and ease of understanding, the forthcoming description includes explanation of techniques for detecting misalignment of one printing pen. The techniques described are applicable for detecting misalignment in multiple print pens of the print head assembly.

In an example, an alignment pattern is printed by the printer. The alignment pattern may be printed on a print media, such as a paper or a plastic sheet. The alignment pattern may include multiple patterns printed by the printing pens of the printer. In an example, each of the multiple patterns include a first symbol and a second symbol printed adjacent to each other in a juxtaposed position such that one side of the first symbol is in connection with one side of the second symbol.

Further, each pattern is printed with a predefined value of deviation in between position of the second symbol and position of the first symbol. When the printing pen prints on the printed media without any misalignment, the predefined value of deviation is referred to as an ideal deviation. That is, when the printing pen is aligned within the print head assembly, the predetermined offset in position of the first symbol and the second symbol of a pattern, is referred to as the ideal deviation of the patter. However, when the printing pen is misaligned, the offset between the first symbol and the second symbol of the pattern is different from the ideal deviation between the first symbol and the second symbol of the patter, and is referred to as an actual deviation of the pattern.

In an example implementation of the present subject matter, the alignment pattern may be provided to a portable electronic device, such as a smartphone, a tablet, a Personal Digital Assistant (PDA), and a laptop. In an example, the alignment pattern may be provided as a multimedia content, for instance as an image or as a video, to the portable electronic device.

The portable electronic device then processes the alignment pattern to detect the misalignment in the printing pen. During processing, the ideal deviation between the first symbol and the second symbol of the patter is determined. Thereafter, the position of the first symbol and the position of the second symbol within the pattern is detected. That is, actual deviation between the positions of the first symbol and the second symbol is determined. Any difference in value of the actual deviation and the ideal deviation of a pattern is due to misalignment of the printing pen. In one example, values of the ideal deviation and the actual deviation is determined for all patterns within the alignment pattern, printed by the printing pen.

After determining the values of actual deviation for the patterns, a relation between the values of the ideal deviation and the values of the actual deviation corresponding to the patterns is established. In an example, based on the established relation for a given value of actual deviation, a corresponding value of the ideal deviation can be determined. In an example implementation of the present subject matter, a value of the ideal deviation for a zero value of the actual deviation is determined. The value of the ideal deviation is identified as the corrective value of alignment for the printing pen of the printer. In a similar manner, corrective values for other printing pens having misalignment is determined based on corresponding ideal deviation and actual deviation of patterns printed by the other printing pens.

In an example, the corrective values are then transmitted to the printer for calibration of the printing pens. For example, if the corrective value for a printing pen is 1.27 dots, then the printing pen is adjusted and realigned within the print head assembly based on the corrective value of 1.27 dots, to reduce the misalignment.

The described techniques allow smartphones and other portable electronic devices to capture the alignment pattern for processing and determining the corrective value thereby providing cost and time efficient approach for detecting the misalignment in printing pens of a printer. Further, the described techniques take into account factors, such as image distortion and blurriness during capturing of the image, therefore the corrective values determined are accurate and precise.

The above described techniques are further described with reference to FIG. 1 to FIG. 7. It should be noted that the description and figures merely illustrate the principles of the present subject matter along with examples described herein and, should not be construed as a limitation to the present subject matter. It is thus noted that various arrangements may be devised that, although not explicitly described or shown herein, describe the principles of the present subject matter. Moreover, all statements herein reciting principles, aspects, and examples of the present subject matter, as well as specific examples thereof, are intended to encompass equivalents thereof.

FIG. 1 schematically illustrates an environment 100 according to an implementation of the present subject matter. The environment 100 includes a printer 102 communicatively coupled to multiple portable electronic devices, 104-1, 104-2, 104-3, and 104-4 through a communication network. In an example implementation, the printer 102 may be an inkjet printer. In another example, the printer 102 may be an integrated printer unit having a scanner, and a copier or may be a stand-alone printer. It would be noted that the printer 102 has a print head assembly having multiple printing pens with either one printing pen or more than one printing pen being misaligned.

The portable electronic devices 104-1, 104-2, 104-3, 104-4 may include smartphones, Personal Digital Assistants (PDA), laptops, tablets, cellphones or e-readers having a camera or being associated with an external image capturing device. For sake of reference, a portable electronic device 104-1, 104-2, 104-3, or 104-4 is referred to as a calibration system 104, hereinafter.

In an example implementation of the present subject matter, the communication network includes a short-range wireless communication, such as one of a Bluetooth connectivity, a Near Field Communication (NFC), a Zigbee communication, an infrared communication, a Wi-Fi communication. In an example, the wireless communication is performed based on Internet Protocol (IP) address of the printer 102. In an example, the communication network includes wired connection, such as a Local Area Network (LAN) cable or an Ethernet cable.

The calibration system 104 comprises module(s) 106 that perform different functionalities, such as determining a corrective value of alignment for printing pen of the printer 102. Accordingly, the module(s) 106 may include an alignment module 108. In operation, the printer 102 prints an alignment pattern on a print media, such as a paper or a plastic sheet. In one example, the alignment patter includes content, such as patterns that are printed by the printing pens of the printer 102.

The calibration system 104 receives the alignment pattern to determine misalignment in the printing pen. In an example implementation, a corrective value is determined in terms of a printing resolution of the printer 102, such as 600 Dots Per Inch (DPI) to 1200 DPI. For example, if the corrective value determined for the printing pen is −1.27 dots, then the printing pen is to be aligned by a value of −1.27 dots within the print head assembly of the printer 102 for correcting the misalignment. After determining the corrective values of alignment for the printing pen, the calibration system 104 transmits the corrective value to the printer 102 for calibration of the printing pen through the communication network.

The detailed explanation of the functionality of the calibration system 104 has been explained in conjunction with description of forthcoming figures.

Figure 2:
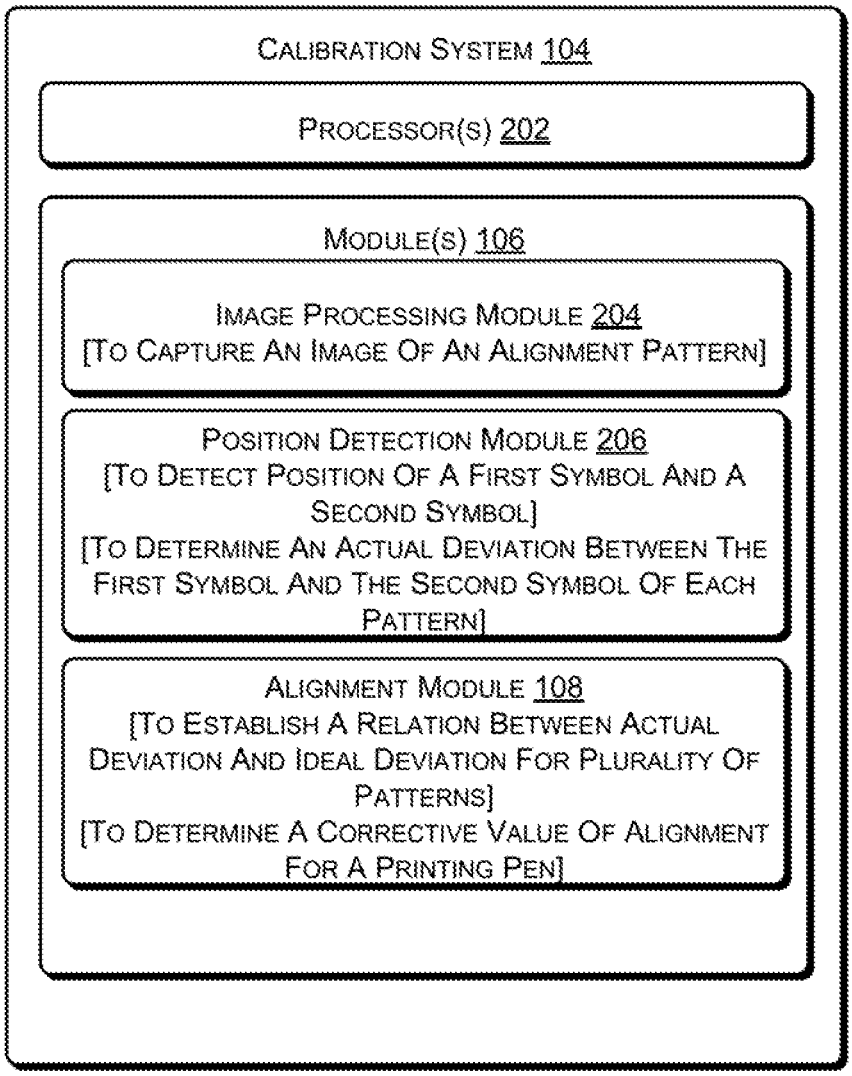
FIG. 2 is a schematic representation of a calibration system for calibrating a printing pen of a printer, in accordance with an example implementation of the present subject matter.

FIG. 2 schematically illustrates components of the calibration system 104, according to an example implementation of the present subject matter. In an implementation of the present subject matter, the calibration system 104 may include a processor 202 and the module(s) 106.

The processor 202 may be implemented as microprocessors, microcomputers, microcontrollers, digital signal processors, central processing units, state machines, logic circuitries, and/or any devices that manipulate signals based on operational instructions. Among other capabilities, the processor(s) 202 may fetch and execute computer-readable instructions stored in a memory. The functions of the various elements shown in the figure, including any functional blocks labeled as "processor(s)", may be provided through the use of dedicated hardware as well as hardware capable of executing machine readable instructions.

The module(s) 106 of the calibration system 104 may include routines, programs, objects, components, data structures, and the like, which perform particular tasks or implement particular abstract data types. The module(s) 106 may further include modules that supplement functioning of the calibration system 104, for example, performance of an operating system. Further, the module(s) 106 can be implemented as hardware units, or may be implemented as instructions executed by a processing unit, or by a combination thereof.

In another aspect of the present subject matter, the module(s) 106 may be machine-readable instructions which, when executed by a processor/processing unit, perform any of the described functionalities. The machine-readable instructions may be stored on an electronic memory device, hard disk, optical disk or other machine-readable storage medium or non-transitory medium. In one implementation, the machine-readable instructions can also be downloaded to the storage medium via a network connection.

The module(s) 106 may perform additional functionalities which includes, capturing an image of an alignment pattern printed by the printer 102, and detecting position of patterns within the alignment pattern. Accordingly, the module(s) 106 may include, apart from the alignment module 108, an image processing module 204, and a position detection module 206.

In operation, the image processing module 204 captures an image of the alignment pattern such that the captured image is aligned with a screen frame of the calibration system 104. In an example, for aligning the captured image with the screen frame of the calibration system 104, the image processing module 204 captures the image based on position markers present on the alignment pattern. In an example, the position markers may be present on top left side, top right side, and bottom left side of the alignment pattern.

In an example implementation of the present subject matter, the alignment pattern comprises of multiple patterns where each pattern may include a first symbol and a second symbol, printed in a juxtaposed position. Each pattern may be printed such that one side of the first symbol is in connection with one side of the second symbol. In an implementation of the present subject matter, each pattern is associated with a predefined value of deviation, between position of the first symbol and position of the second symbol, referred to as an ideal deviation. As described earlier, the ideal deviation is an offset between the first symbol and the second symbol when there is no misalignment in the printing pen and the printing pens of the print head assembly are aligned. However, it would be noted that the patterns included in the alignment pattern, as printed by the printing pen of the printer 102, may include deviation other than the ideal deviation, due to the misalignment of the printing pen within the print head assembly.

The position detection module 206 detects position of the first and the second symbol and determines actual deviation between position of the first symbol and the position of the second symbol for each pattern.

In an example implementation of the present subject matter, the alignment module 108 establishes a relation between the actual deviation determined for multiple patterns of the alignment pattern and the ideal deviation associated with the multiple patterns. The relation, for instance, is an equation that includes variables corresponding to both the ideal deviation and actual deviation for the multiple patterns such that for any value of actual deviation, a corresponding value of ideal deviation can be determined. Upon establishing the relation, the alignment module 108 may determine a value of ideal deviation corresponding to zero value of the actual deviation from the relation. The ideal deviation, corresponding to zero value of the actual deviation, is indicative of corrective value of alignment for the printing pen based on which the printing pen is to be aligned to eliminate the misalignment.

In the example implementation, the calibration system 104 may capture the image of the alignment pattern through the image processing module 204, implemented in a Complementary Metal Oxide Semiconductor (CMOS) image sensor or a Charge Coupled Device (CCD) image sensor. The image may be captured based on the position markers on the alignment pattern such that the image of the alignment pattern aligns with a screen frame of the smartphone. In the example implementation, after capturing the image, the calibration system 104 may process the image to determine the corrective value of alignment for the printing pen.

The calibration system 104 utilizes various application modules, such as the position detection module 206 and the alignment module 108 to determine the corrective value. For instance, the calibration system 104 detects positions of the first symbol and the second symbol, and determines actual deviation between the first symbol and the second symbol using the position detection module 206. Thereafter, the calibration system 104 derives a relation between the actual deviation and the ideal deviation for the multiple patterns and determines a value of ideal deviation for zero value of the actual deviation, by utilizing the alignment module 108. The value of the ideal deviation is then transmitted to the printer 102, through a short range communication, for instance Bluetooth, for calibrating the printing pen to reduce the misalignment.

Further, the details of the functioning of various modules 106 of the calibration system 104 are described with reference to the description of FIG. 3 and FIG. 4.

Figure 3:
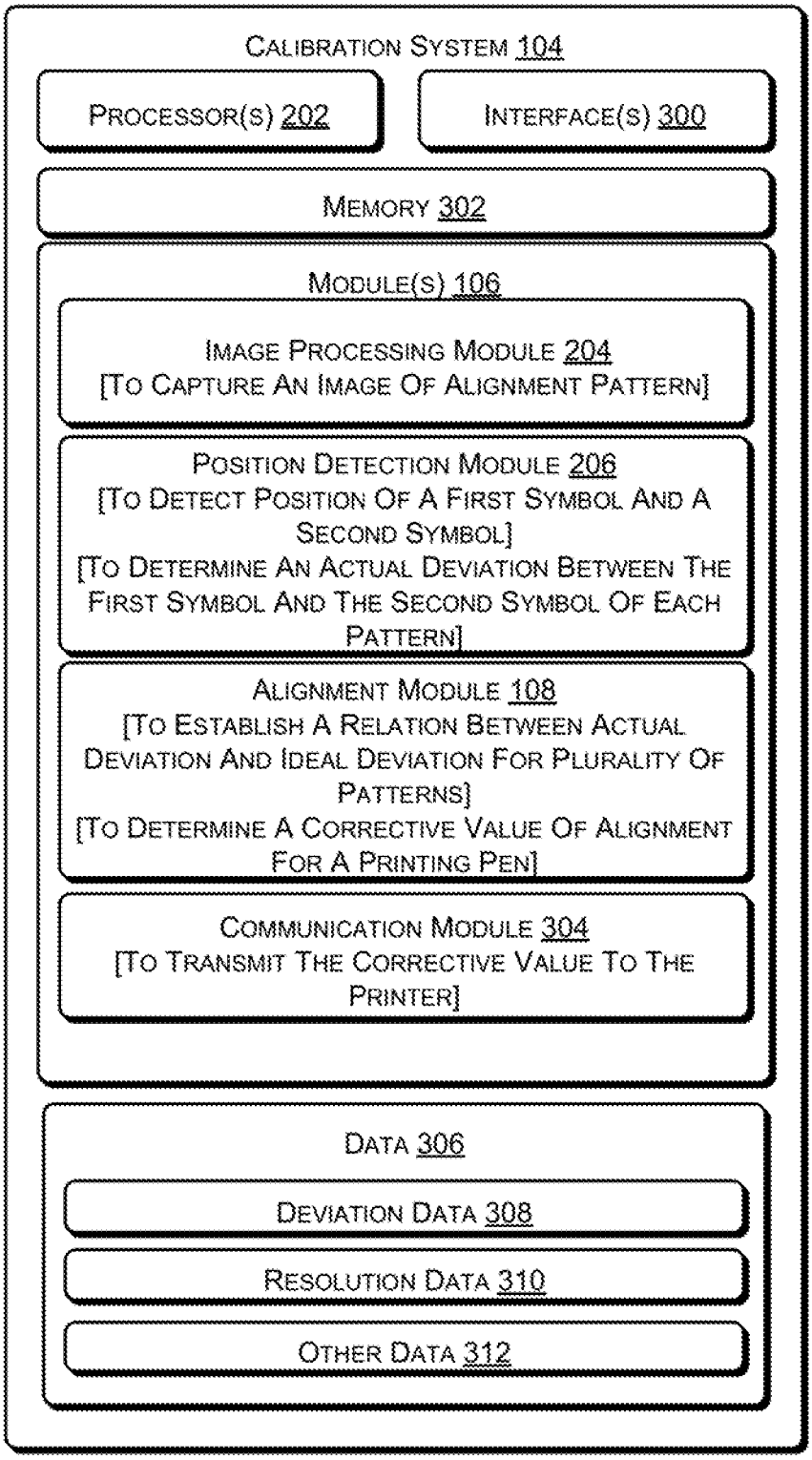
FIG. 3 illustrates a schematic representation of a calibration system for calibrating a printing pen of a printer, in accordance with an example implementation of the present subject matter.

FIG. 3 schematically illustrates different components of the calibration system 104, according to an implementation of the present subject matter. In an implementation of the present subject matter, the calibration system 104 comprises, apart from the processor 202, an interface 300, a memory 302, and the communication module 304 and data 306.

The interface(s) 300 may include a variety of machine readable instructions-based interfaces and hardware interfaces that allow the calibration system 104 to interact with different entities, such as the processor 202, and the module(s) 106. Further, the interface(s) 300 may enable the components of the calibration system 104 to communicate with other systems, and external sources. The interfaces 300 may facilitate multiple communications within a wide variety of networks and protocol types, including wireless networks, wireless Local Area Network (WLAN), RAN, satellite-based network, etc.

The memory 302 may be coupled to the processor 202 and may, among other capabilities, provide data and instructions for generating different requests. The memory 302 can include any computer-readable medium known in the art including, for example, volatile memory, such as static random access memory (SRAM) and dynamic random access memory (DRAM), and/or non-volatile memory, such as Read Only Memory (ROM), erasable programmable ROM, flash memories, hard disks, optical disks, and magnetic tapes.

Further, the module(s) 106 include an additional module, such as the communication module 304. The communication module 304 allows the calibration system 104 communicate data with other devices, such as the printer 102.

The data 306 serves, amongst other things, as a repository for storing information that may be fetched, processed, received, or generated by the module(s) 106 and deviation data 308, resolution data 310, and other data 312. The deviation data 308 may include values, such as ideal deviation for each pattern in the alignment pattern, and resolution data 310 may include printing resolution of the printer 102 for printing the alignment pattern. The other data 312 may include printer identification to identify the printer for transmitting any data to the printer 102.

Figure 4:
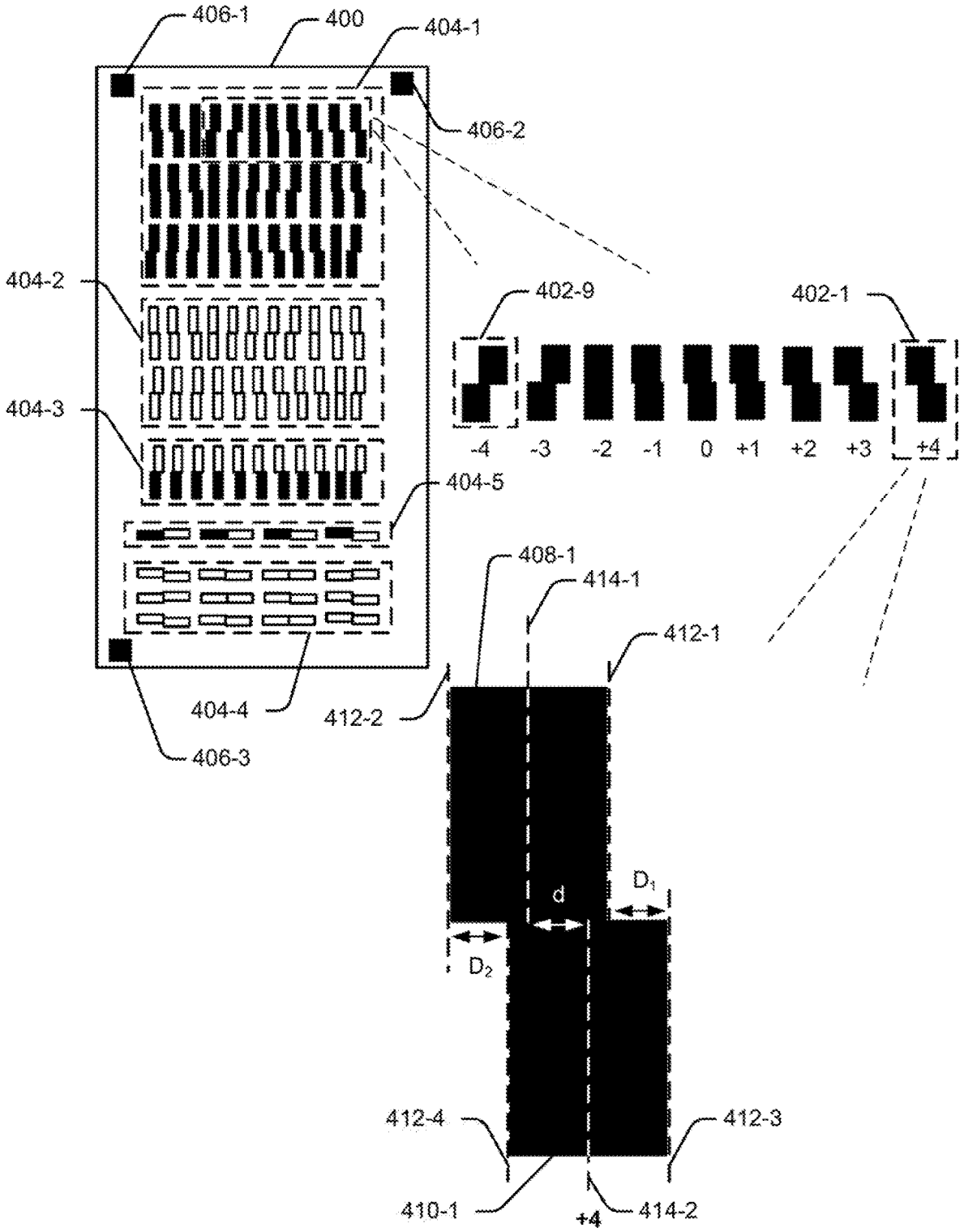
FIG. 4 illustrates an example alignment pattern printed by a printer, according to an example implementation of the present subject matter.

For sake of explanation, the functioning of different components of the calibration system 104 in processing the alignment pattern to determine the corrective value is described in conjunction with the description of FIG. 4.

FIG. 4 illustrates an example alignment pattern 400 printed by the printer 102 according to an example implementation of the present subject matter. The alignment pattern 400 may be printed on a print media, such as a paper and comprises multiple patterns 402-1, 402-2, 402-3, . . . **402-*n*. For reference, the multiple patterns 402-1, 402-2, 402-3, . . . 402-*n* have been collectively referred to as patterns 402 and individually as a pattern 402 hereinafter. The patterns 402 are distributed across multiple sets of rows 404-1, 404-2, 404-3, and 404-4 where each set of rows corresponds to patterns 402 printed by a printing pen in an operation mode, wherein the printing pen may have misalignment. For instance, the set of rows 404-1 is printed by a black printing pen in forward and reverse printing direction at slow and fast carriage slew and the set of rows 404-2 is printed by a coloured printing pen in forward and reverse printing direction. Further, the set of rows 404-3 is printed by the coloured printing pen and the black printing pen in a predefined direction, such as in pen to pen x-pattern, and the set of rows 404-4 and set of rows 404-5 are printed by the printing pen in pen to pen y-pattern. The set of rows 404-4 is, for instance detecting misalignment along y-pattern of the printing pen, such as during linefeed or paper feed in the printer 102 for printing the alignment pattern 400**, and then calibrating the printing pen along the y-pattern. In an example, the black printing pen and the colour printing pen have misalignment.

In an example, the alignment pattern 400 may include position markers 406-1, 406-2, and 406-3 located at the top left of the alignment pattern 400, top right of the alignment pattern 400, and bottom left of the alignment pattern 400 respectively. Further, the pattern 402-1 comprises a first symbol 408-1 and a second symbol 410-1. For the ease of explanation, it has been described that a pattern 402 comprises a corresponding first symbol 408 and a corresponding second symbol 410.

In an example implementation, the first symbol 408-1 has a top right boundary 412-1 and a top left boundary 412-2 and the second symbol 410-1 has a bottom right boundary 412-3 and a bottom left boundary 412-4 respectively. Further, the first symbol 408-1 has a line of symmetry 414-1, and the second symbol 410-1 has a line of symmetry 414-2.

Further, each pattern 402 is associated with a value of ideal deviation of one of −4, −3, −2, −1, 0, +1, +2, +3, and +4. For instance, the pattern 402-1 is associated with the ideal deviation +4. The ideal deviation of +4 implies that in a condition where there is no misalignment in the printing pen, the offset in position of the first symbol 408-1 and the second symbol 410-1 is +4 dots, where the offset is measured in terms of printing resolution, such as 600 Dots per Inch (DPI) to 1200 DPI.

In one example, the offset between the top right boundary 412-1 of the first symbol 408-1 and the bottom right boundary 412-3 of the second symbol 410-1 is denoted as $D_1$, and the offset between the top left boundary 412-2 of the first symbol 408-1 and the bottom left boundary 412-4 of the second symbol 410-1 is denoted as $D_2$. Further, the deviation between line of symmetry 414-1 and line of symmetry 414-2 is denoted as d.

Referring to FIG. 3, the image processing module 204 of the calibration system 104 captures the image of the alignment pattern 400 based on the position markers 406-1, 406-2, and 406-3. In a scenario, the image captured by the image processing module 204 may be subjected to image distortion and blurriness based on various factors, such as inappropriate handling of device or positioning of a camera of the device during capturing the image, insufficient light conditions, and lower resolution of the camera. On some instances, the captured image may have low image quality depending upon type, capability and quality of camera used for capturing the image.

As described earlier, in the alignment pattern 400, each pattern 402 is associated with a value of ideal deviation. The value of ideal deviation for each pattern 402 may be stored in the data 306 as deviation data 308.

After capturing the image of the alignment pattern 400, the position detection module 206 may detect position of the first symbol 408 and position of the second symbol 410 of a pattern 402-1 based on the boundaries of the first symbol 408 and the boundaries of the second symbol 410. For instance, the position detection module 206 may detect the position of the top left boundary 412-2 and the top right boundary 412-1 of the first symbol 408-1 based on boundary detection techniques and detects position of the first symbol 408-1. In an example, the position of the boundary is detected in native image resolution. The native image resolution is the resolution of the image captured by the image processing module 204 and is determined in pixels (px). In one example, the native image resolution may vary based on factors, such as specification of the image processing module 204, and distance between the alignment pattern 400 and the image processing module 204. The position detection module 206 may then detect the bottom right boundary 412-3 and the bottom left boundary 412-4 of the second symbol 410-1 to detect position of the second symbol 410-1.

In another example, the position detection module 206 may detect the position of the symbols based on position of respective line of symmetries of the symbols. The position detection module 206 may detect the position of the line of symmetry 414-1 of the first symbol 408-1 and assigns the detected position to the first symbol 408-1.

Upon detecting the position of first symbol 408-1 and second symbol 410-1, the position detection module 206 may determine the actual deviation between position of the first symbol 408-1 and the position of the second symbol 410-1.

In an example, the determination of the actual deviation may be based on position of the boundaries of the two symbols. In another example, the determination of the actual deviation may be based on line of symmetry of the first symbol 408 and the line of symmetry of the second symbol 410.

In one example, each value of the actual deviation for each pattern 402 within the set of rows 404-1 is determined as a value of line setting, referred to as Measured Line Setting (MLS), and the ideal deviation is determined as a value of Ideal Line Setting (ILS). In the example, the MLS is measured in the native image resolution of the image and the ILS is measured in print resolution of the printer.

For each pattern 402 within the set of rows 404-1, the position detection module 206 may detect the offset $D_1$ between top right boundary 412-1 of the first symbol 408-1 and the bottom right boundary 412-3 of the second symbol 410-1, and the offset $D_2$ between the top left boundary 412-2 of the first symbol 408-1 and the bottom left boundary 412-4 of the second symbol 410-1. Thereafter, the position detection module 206 determines the MLS as an average value of $D_1$ and $D_2$, given as:

$$\text{Measured Line Setting (MLS)}=((\text{Bottom right boundary}-\text{top right boundary})+(\text{Bottom left boundary}-\text{top left boundary}))/2$$

OR $$MLS = \frac{D1 + D2}{2}$$

In an example implementation of the present subject matter, the MLS for the pattern 402-1 may also be equivalent to the offset between position of line of symmetry 414-1 and position of line of symmetry 414-2.

After determining MLS for each pattern, multiple values of MLS are obtained for the multiple patterns 402 within the set of rows 404-1, where each pattern is also associated with a value of ILS. In a similar manner, values of actual deviation are determined for the remaining patterns 402 in the set of rows 404-1 printed by a printing pen, for instance, the black printing pen having misalignment, and values of ideal deviation and actual deviation are determined for each pattern within other sets of rows 404-2, and 404-3 printed by other printing pens.

As described earlier, a relation between the ideal deviation and the actual deviation is established by the alignment module 108. An example of processing the multiple values of actual deviation computed in terms of MLS and the ideal deviation or the ILS, by the alignment module 108, to determine the relation between the ideal deviation, and the actual deviation is further described with reference to FIG. 5. it would be noted that the relation between the MLS and the ILS, as described in FIG. 5 is an example relation, and the alignment module 108 may also utilize other methods to establish a relation between the MLS and the ILS.

Figure 5:
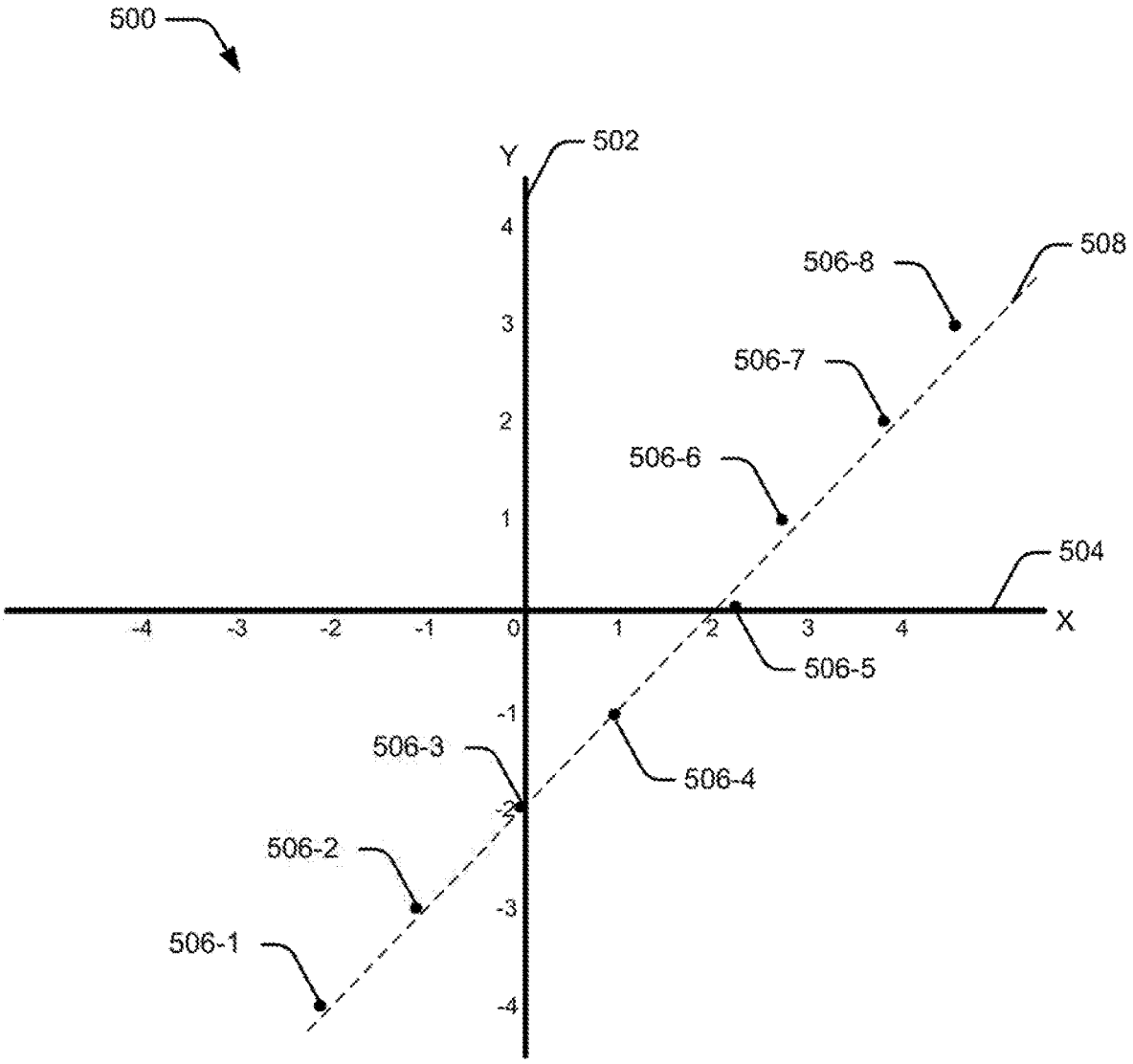
FIG. 5 illustrates an example graph for determining a corrective value of alignment for a printing pen of a printer, according to an example implementation of the present subject matter.

FIG. 5 illustrates an x-y graph 500 with y-axis 502 representing the values of ILS for the multiple patterns and x-axis 504 representing the values of the MLS for the multiple patterns. A point is plotted on the x-y graph for each pattern based on the MLS and ILS value of the pattern of the set of rows 404-1.

For example, the MLS obtained for the pattern 402-9, when the position of bottom right boundary of the second symbol of the pattern 402-9 is determined to be 132.03 pixels (px) in the native image resolution, the position of top right boundary of the first symbol of the pattern 402-9 is determined to be 130 px, the position of bottom left boundary of the second symbol of the pattern 402-9 is determined to be 102.03 px, and the position of top left boundary of the first symbol of the pattern 402-9 is determined to be 100 px is:

$$MLS=(132.03-130)+(102.03-100)/2=-2.03 \text{ px}$$

Since the ILS value corresponding to the pattern 402-9 is −4 dpi, the point 506-1 corresponding to a value of −2.03 px on the x-axis 504 and a value of −4 dpi on the y-axis 502 is plotted. The point 506-1 denotes the point corresponding to the pattern 402-9. In a similar manner, the MLS values for pattern 402-7 and 402-1 are determined to be −0.067 px, and 6.12 px respectively, and plotted on the graph. Accordingly, points corresponding to the remaining patterns are also plotted on the x-y graph 500. For sake of reference, the multiple points 506-1, 506-2, . . . , and 506-7 have been collectively referred to as points 506.

After plotting the multiple points 506 for the patterns 402-1, 402-2, . . . 402-9, the alignment module 108 applies a line fitting to the multiple points 506 to obtain a straight line 508. In an example implementation, after determining the straight line 508, the alignment module 108 determines an equation of the straight line 508. In an example, the equation of the straight line 508 represents the relation between the ideal deviation and actual deviation.

In an example, the alignment module 108 determines a value of the ideal deviation, corresponding to a zero value of the actual deviation. That is, the value of the y-intercept of the straight line 508, representing ideal value of deviation when the actual deviation is zero. In the above example, the value of the y-intercept may be determined to be −1.87. The value of the ideal deviation, when the actual deviation is zero, is indicative of the miss calibration in the printing pen. Therefore, the corrective value for calibrating the printing pen of the printer 102 is −1.87. It would be noted that the corrective value corresponds to the misalignment in one printing pen, for instance, the black printing pen.

Thereafter, the alignment module 108 may calculate the corrective value for each set of row 404-2, and 404-3 in the alignment pattern 400 to determine a corrective value for each printing pen having misalignment.

In an example implementation of the present subject matter, the communication module 304 transmits the multiple corrective values to the printer 102, based on the printer identification, for calibration of the printing pens within the printer 102.

Figure 6:
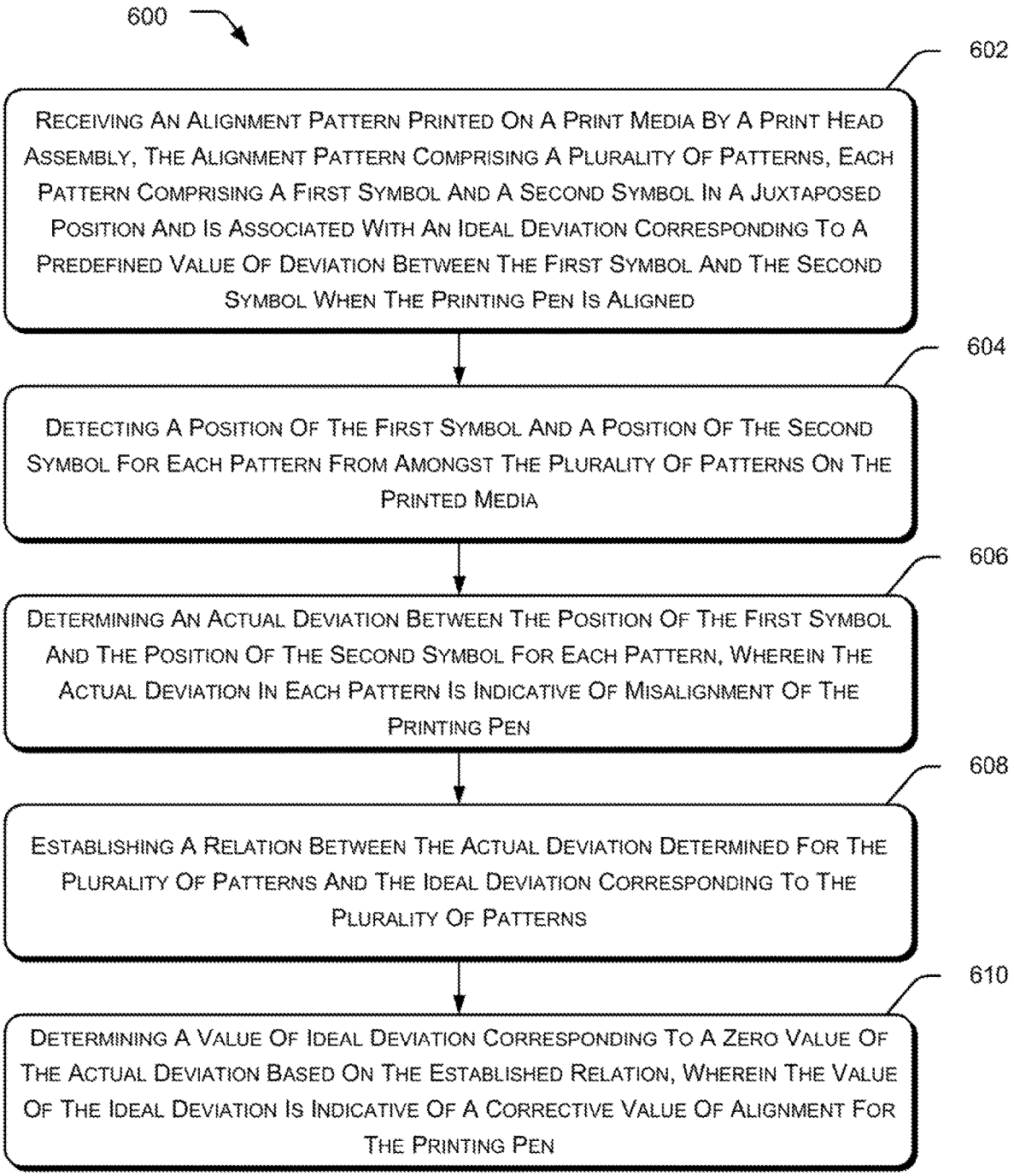
FIG. 6 illustrates an example method for determining a corrective value of alignment for a printing pen of a printer, according to an example implementation of the present subject matter.

FIG. 6 illustrates a method 600 for calibrating a printing pen of a print head assembly. The order in which the method 600 is described is not intended to be construed as a limitation, and any number of the described method blocks may be combined in any order to implement the method 600, or an alternative method. Furthermore, the method 600 may be implemented by processor(s) or computing system(s), such as one of systems 104, through any suitable hardware, non-transitory machine readable instructions, or combination thereof.

It may be noted that steps of the method 600 may be performed by programmed computing systems, such as the calibration system 104. The steps of the method 600 may be executed based on instructions stored in a non-transitory computer readable medium, as will be readily noted. The non-transitory computer readable medium may include, for example, digital memories, magnetic storage media, such as magnetic disks and magnetic tapes, hard drives, or optically readable digital data storage media.

Referring to FIG. 6, in an implementation of the present subject matter, at block 602, an alignment pattern printed on a print media by a print head assembly is received. In an example, the alignment pattern is received by a portable electronic device, such as the calibration system 104. Examples of such calibration system 104 include a smartphone, a tablet, a laptop, and a PDA. The alignment pattern can be received through the camera of the portable electronic device by either capturing an image of the alignment pattern or by capturing a video of the alignment pattern. In another example, the camera of the portable electronic device may focus on the alignment pattern to receive the alignment pattern. In another example, the portable electronic device may receive the alignment pattern from another computing device, such as another portable electronic device or a desktop computer, communicatively coupled to the portable electronic device through a wired or a wireless connection.

The alignment pattern has multiple patterns and each pattern has two symbols, a first symbol and a second symbol printed in a juxtaposed position. Each pattern has an ideal deviation that corresponds to a predefined value of deviation between the first symbol and the second symbol of each pattern when there is no misalignment and the printing pen is aligned within the print head assembly of the printer 102.

Thereafter at block 604, a position of the first symbol and a position of the second symbol is detected within the pattern on the printed media. In an example implementation, the position detection module 206 of the calibration system 104 detects the position of the first symbol 408 and the second symbol 410 based on a boundary detection technique. After detecting the position, the actual deviation between the position of the first symbol and the position of the second symbol is determined for each pattern at block 606. It would be noted that the misalignment of the printing pen causes the actual deviation in the position of the first and the second symbol. In one example, the position detection module 206 determines the deviation in between the position of the first symbol 408 and the position of the second symbol 410 for each pattern 402.

At block 608, a relation is established between the actual deviation for the multiple patterns and the ideal deviation associated with the multiple patterns. In an example implementation, the alignment module 108 establishes the relation between the multiple values of the ideal deviation and the actual deviation for the multiple patterns 402.

At block 610, a value of ideal deviation corresponding to a zero value of the actual deviation is determined based on the determined relation. In an example implementation of the present subject matter, the alignment module 108 of the calibration system 104 determines the value of the ideal deviation for zero value of the actual deviation. The value of the ideal deviation is indicative of the corrective value of alignment for the printing pen.

Figure 7:
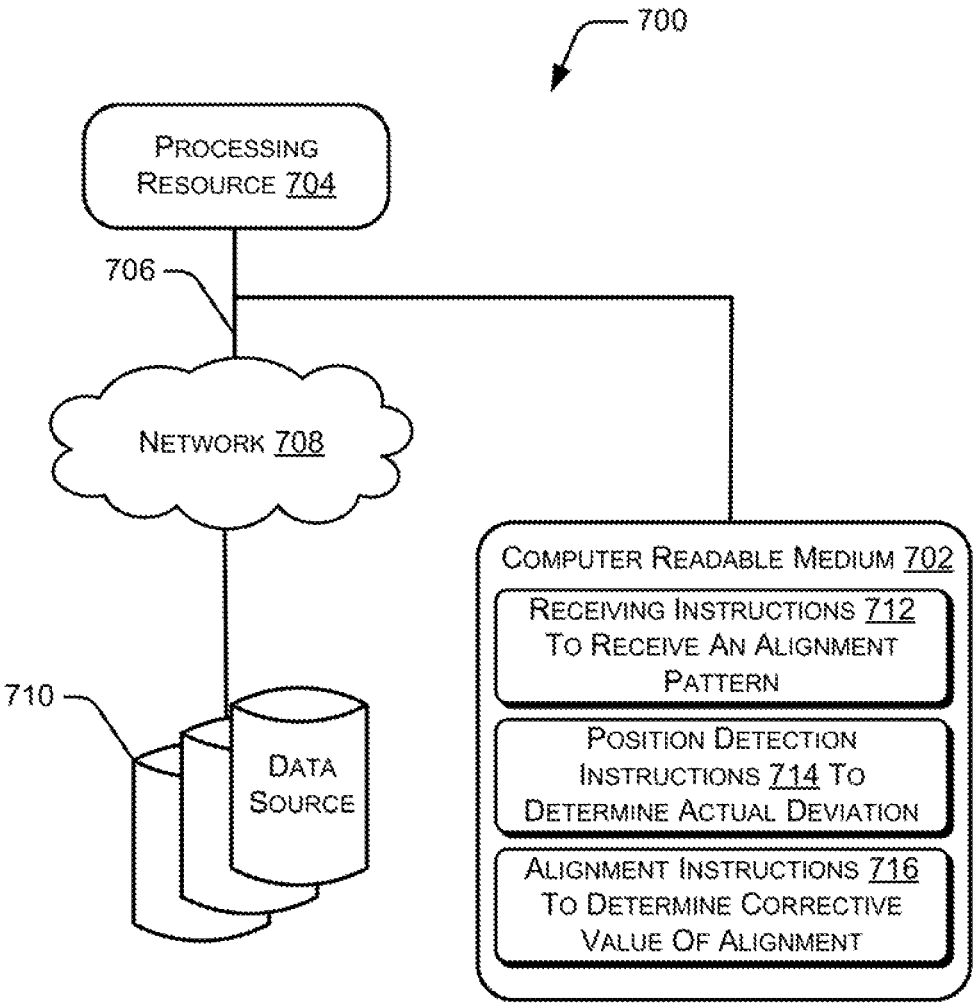
FIG. 7 illustrates an example computing environment, implementing a non-transitory computer-readable medium storing instructions for executing an operation for determining a corrective value of alignment for a printing pen of a printer, according to an example implementation of the present subject matter.

FIG. 7 illustrates a computing environment 700 implementing a non-transitory computer-readable medium 702, according to an implementation of the present subject matter. In an example implementation, the non-transitory computer-readable medium 702 may be utilized by a portable computing device, such as the calibration system 104 (not shown). The calibration system 104 may be implemented in a public networking environment or a private networking environment. In one implementation, the computing environment 700 may include a processing resource 704 communicatively coupled to the non-transitory computer-readable medium 702 through a communication link 706 connecting to a network 708.

For example, the processing resource 704 may be implemented in a portable electronic device, such as the calibration system 104 as described earlier. The non-transitory computer-readable medium 702 may be, for example, an internal memory device or an external memory device. In one implementation, the communication link 706 may be a direct communication link, such as any memory read/write interface. In another implementation, the communication link 706 may be an indirect communication link, such as a network interface. In such a case, the processing resource 704 may access the non-transitory computer-readable medium 702 through the network 708. The network 708 may be a single network or a combination of multiple networks and may use a variety of different communication protocols.

The processing resource 704 may be communicating with the computing environment 700 over the network 708 to access data source 710. In one implementation, the non-transitory computer-readable medium 702 includes a set of computer-readable instructions, such as instructions to receive the alignment pattern 712 (instructions 712), instructions to determine actual deviation 714 (instructions 714), and instructions to determine corrective value of alignment 716 (instructions 716). The set of computer-readable instructions may be accessed by the processing resource 704 through the communication link 706 and subsequently executed to determine the corrective value of alignment for a printing pen having misalignment within a print head assembly of a printer, such as printer 102.

It would be noted that there may be multiple printing pens within the printer 102 having misalignment, however, for ease of explanation, detecting misalignment and determining the corrective value for one printing pen has been explained in the forthcoming description.

The instructions 712 are accessed by the processing resource 704 to allow receiving of the alignment pattern. In an example implementation, the instructions 712 may be implemented as the image processing module 204 of the system 104 to allow capturing of the image of the alignment pattern 400. In another example, the instructions 712 when executed by the processing resource 704 allows receiving the alignment pattern from another portable electronic device. The alignment pattern includes multiple sets of rows, such as 404-1, where each row comprises multiple patterns, such as patterns 402 within the set of rows 404-1. Each set of rows corresponds to patterns printed by the printing pen in an operating mode, such as bidirectional printing by the printing pen at slow and fast carriage slew, and printing in one direction.

In an example implementation, the non-transitory computer readable medium 702 may include other instructions (not shown in the figure), such as instructions to adjust position of the alignment pattern. In one example implementation, the processing resource 704 accesses the instructions to adjust position of the alignment pattern to determine skew in the position of the alignment patter based on position markers on the alignment pattern that allow determination of the position and alignment of the alignment pattern. Further, the processing resource 704 accesses the instructions to adjust the position of the alignment pattern to eliminate the skew by aligning the position of the alignment pattern.

Each pattern within a set of rows comprises a first symbol and a second symbol printed adjacent to each other such that one side of the first symbol is in connection with one side of the second symbol. Further, each pattern is assigned an ideal deviation corresponding to a predefined value of deviation when the printing pen is aligned within the print head assembly. The instructions 714 are accessed by the processing resource 704 to detect a position of the first symbol and a position of the second symbol for each pattern on the printed media utilizing an edge detection technique and to determine actual deviation for each pattern. The actual deviation corresponds to misalignment of the printing pen. In an example implementation, the instructions 714 are implemented as position detection module 206 in the calibration system 104 to perform the functionality of detecting position and the actual deviation for each pattern.

After executing the instructions 714, the processing resource 704 executes the instructions 716 to establish a relation between multiple values of ideal deviation and multiple values of actual deviation for the multiple patterns. The relation may be, for instance an equation of a line, such as the straight line 508 described with reference to FIG. 5. The relation may have variables representing the actual deviation and the ideal deviation such that for each value of actual deviation there is a corresponding value of ideal deviation that can be determined from the relation.

Thereafter, the processing resource 704 determines value of the ideal deviation for a zero value of the actual deviation. The value of ideal deviation is the corrective value of alignment for calibrating the printing pen. In an example, the instructions 716 are implemented as the alignment module 108 of the calibration system 104 to establish the relation and determine the corrective value of alignment.

Further, the processing resource 704 accesses instructions to transmit the corrective value (not shown in the figure) to provide the corrective value to a printer, for instance the printer 102 based on which the printer 102 may then calibrate the printing pen to reduce the misalignment.

Therefore, the described techniques provide a time and cost efficient approach for detecting the misalignment for calibration of the printing pen. Further, the described techniques provide enhanced accuracy in detecting the misalignment thereby facilitating error free calibration of the printing pen.

Although implementations of present subject matter have been described in language specific to structural features and/or methods, it is to be noted that the present subject matter is not limited to the specific features or methods described. Rather, the specific features and methods are disclosed and explained in the context of a few implementations for the present subject matter.

What is claimed is:

1. A method of a system comprising a hardware processor for calibrating a printing pen of a print head assembly, the method comprising:

receiving an alignment pattern printed on a print media by the print head assembly, the alignment pattern comprising a plurality of patterns, wherein each respective pattern of the plurality of patterns comprises a first symbol and a second symbol in a juxtaposed position, wherein the respective pattern is associated with an ideal deviation corresponding to a predefined value of deviation between a position of the first symbol and a position of the second symbol within the respective pattern when the printing pen is aligned;

detecting a position of the first symbol and a position of the second symbol on the print media for each pattern of the plurality of patterns;

determining an actual deviation between the detected position of the first symbol and the detected position of the second symbol on the print media for each pattern, wherein the actual deviation for each pattern is indicative of misalignment of the printing pen;

establishing a relation between the actual deviation determined for the plurality of patterns on the print media and the ideal deviation corresponding to the plurality of patterns; and determining a value of the ideal deviation corresponding to a zero value of the actual deviation based on the established relation, wherein the value of the ideal deviation is indicative of a corrective value of alignment for the printing pen.

2. The method of claim 1, wherein the detecting is based on a boundary of the first symbol and a boundary of the second symbol.

3. The method of claim 2, wherein the determining the actual deviation comprises:

detecting the boundary of the first symbol and the boundary of the second symbol for each pattern of the plurality of patterns; and determining a difference in a position of the boundary of the second symbol and a position of the boundary of the first symbol on two sides of the first symbol.

4. The method of claim 1, wherein the determining the actual deviation is based on an offset between a line of symmetry of the first symbol and a line of symmetry of the second symbol for each pattern of the plurality of patterns.

5. The method of claim 1, wherein the receiving comprises obtaining an image of the alignment pattern by a camera of a portable electronic device.

6. The method of claim 1, wherein the receiving comprises:

determining a skew in a position of the alignment pattern based on position markers in the alignment pattern, wherein the position markers allow a determination of the position and an alignment of the alignment pattern; and adjusting the position of the alignment pattern to eliminate the skew.

7. The method of claim 1, wherein the determining the value of the ideal deviation comprises plotting the determined actual deviation for each pattern and a corresponding ideal deviation as a plurality of points on a graph.

8. The method of claim 7, wherein the determining the value of the ideal deviation comprises applying line fitting to the plurality of points to obtain a line, wherein the line corresponds to the relation between the actual deviation determined for the plurality of patterns and the ideal deviation corresponding to the plurality of patterns.

9. A system for calibrating a printing pen of a print head assembly in a printer, the system comprising:

a processor; and a non-transitory storage medium storing instructions executable on the processor to:

receive an alignment pattern captured based on position markers in the alignment pattern, wherein the alignment pattern comprises a plurality of patterns printed on a print media, wherein each respective pattern of the plurality of patterns comprises a first symbol and a second symbol in a juxtaposed position, the respective pattern being associated with an ideal deviation, the ideal deviation corresponding to a predefined value of deviation between a position of the first symbol and a position of the second symbol when the printing pen is aligned;

detect, for each pattern of the plurality of patterns, a position of the first symbol and a position of the second symbol on the print media;

determine an actual deviation between the detected position of the first symbol and the detected position of the second symbol for each pattern, wherein the actual deviation is indicative of misalignment of the printing pen;

establish a relation between the actual deviation determined for the plurality of patterns and the ideal deviation associated with the plurality of patterns; and determine a value of the ideal deviation corresponding to a zero value of actual deviation, the value of the ideal deviation being indicative of a corrective value of alignment for the printing pen.

10. The system of claim 9, wherein the instructions are executable on the processor to cause transmission of the corrective value to the printer for aligning the printing pen.

11. The system of claim 9, wherein the instructions are executable on the processor to determine the value of the ideal deviation corresponding to the zero value of the actual deviation by plotting the actual deviation determined for the plurality of patterns and a corresponding ideal deviation as a plurality of points on a graph.

12. The system of claim 9, wherein the instructions are executable on the processor to detect the position of the first symbol and the position of the second symbol based on a position of a line of symmetry of the first symbol and a position of a line of symmetry of the second symbol.

13. A non-transitory computer-readable medium comprising instructions for calibrating a printing pen of a print head assembly in a printer, the instructions upon execution causing a processing resource to:

receive an alignment pattern printed on a print media by the print head assembly, the alignment pattern comprising a plurality of patterns, wherein each respective pattern of the plurality of patterns comprises a first symbol and a second symbol in a juxtaposed position and is associated with an ideal deviation corresponding to a predefined value of deviation between the first symbol and the second symbol within the respective pattern for an aligned printing pen;

detect, for each pattern, a position of the first symbol and a position of the second symbol within the pattern printed on the print media;

determine an actual deviation between the position of the first symbol and the position of the second symbol for each pattern, wherein the actual deviation in each pattern is indicative of misalignment of the printing pen;

establish a relation between the ideal deviation corresponding to the plurality of patterns and the actual deviation determined for the plurality of patterns;

determine a value of the ideal deviation corresponding to a zero value of the actual deviation based on the established relation, wherein the value of the ideal deviation is indicative of a corrective value of alignment for the printing pen; and cause transmission of the corrective value for the alignment pattern to the printer for calibrating the printing pen.

14. The non-transitory computer-readable medium of claim 13, wherein the instructions upon execution cause the processing resource to receive the alignment pattern in a captured image of the alignment pattern.

15. The non-transitory computer-readable medium of claim 13, wherein the instructions upon execution cause the processing resource to:

determine a skew in a position of the alignment pattern based on position markers in the alignment pattern, wherein the position markers allow a determination of the position and an alignment of the alignment pattern; and adjust the position of the alignment pattern to eliminate the skew.

* * * * *